US010024178B2

(12) United States Patent
Benson

(10) Patent No.: US 10,024,178 B2
(45) Date of Patent: Jul. 17, 2018

(54) CHOCKING AND RETAINING DEVICE

(71) Applicant: ROLLS-ROYCE plc, London (GB)

(72) Inventor: Christopher Benson, Swindon (GB)

(73) Assignee: ROLLS-ROYCE plc, London (GB)

( * ) Notice: Subject to any disclaimer, the term of this patent is extended or adjusted under 35 U.S.C. 154(b) by 386 days.

(21) Appl. No.: 15/057,528

(22) Filed: Mar. 1, 2016

(65) Prior Publication Data

US 2016/0265369 A1 Sep. 15, 2016

(30) Foreign Application Priority Data

Mar. 12, 2015 (GB) ..... 1504186.6

(51) Int. Cl.

| | |
|---|---|
| ***F01D 5/32*** | (2006.01) |
| ***F01D 5/30*** | (2006.01) |
| *F01D 5/28* | (2006.01) |
| *F01D 25/06* | (2006.01) |

(52) U.S. Cl.

CPC ..... *F01D 5/323* (2013.01); *F01D 5/3007* (2013.01); *F01D 5/282* (2013.01); *F01D 25/06* (2013.01); *F05D 2220/32* (2013.01); *F05D 2220/36* (2013.01); *F05D 2240/30* (2013.01); *F05D 2260/30* (2013.01); *F05D 2260/96* (2013.01); *F05D 2300/501* (2013.01)

(58) Field of Classification Search

CPC ..... F01D 5/3007; F01D 5/3053; F01D 5/323; F01D 25/06; F05D 2260/30

See application file for complete search history.

(56) References Cited

U.S. PATENT DOCUMENTS

| | | | | |
|---|---|---|---|---|
| 2,942,842 A * | 6/1960 | Hayes | F01D 5/30 416/220 R |
| 3,720,481 A | 3/1973 | Motta | |
| 5,236,309 A | 8/1993 | Van Heusden et al. | |
| 6,905,311 B2 * | 6/2005 | Leathart | F01D 5/323 416/221 |

(Continued)

FOREIGN PATENT DOCUMENTS

| | | |
|---|---|---|
| EP | 0690203 A2 | 1/1996 |
| EP | 1382800 A2 | 1/2004 |

OTHER PUBLICATIONS

Aug. 11, 2016 Search Report issued in European Patent Application No. 16 15 7683.

(Continued)

*Primary Examiner* — Ninh H Nguyen
(74) *Attorney, Agent, or Firm* — Oliff PLC

(57) ABSTRACT

A device for chocking and retaining a dovetail root of a blade of a gas turbine engine in a corresponding axially-extending slot in the rim of a disc, the root being mounted in the slot by insertion of a leading end of the root into a proximal end of the slot and then sliding the root towards a distal end of the slot. The device includes a first wedging body having a key portion receivable in a keyway formed at the distal end of the slot. The keyway restrains the first wedging body against movement in the axial direction. The first wedging body further has a first angled surface over which a correspondingly angled leading end surface of the root slides when the root is inserted in the slot to urge the leading end of the root radially outwardly.

16 Claims, 3 Drawing Sheets

(56) References Cited

U.S. PATENT DOCUMENTS

| | | | | |
|---|---|---|---|---|
| 8,192,167 | B2 * | 6/2012 | Helmis | F01D 5/3015 416/204 R |
| 8,439,635 | B2 * | 5/2013 | Uskert | F01D 5/323 415/189 |
| 2010/0284805 | A1 | 11/2010 | Uskert et al. | |
| 2011/0171031 | A1 | 7/2011 | Benkler et al. | |
| 2013/0216387 | A1 | 8/2013 | Torkaman et al. | |

OTHER PUBLICATIONS

Aug. 21, 2015 Search Report issued in British Patent Application No. 1504186.6.

* cited by examiner

CHOCKING AND RETAINING DEVICE

FIELD OF THE INVENTION

The present invention relates to a device for chocking and retaining a dovetail root of a blade of a gas turbine engine in a corresponding dovetail slot in the rim of a disc.

BACKGROUND OF THE INVENTION

Many aero-engines adopt a dovetail style of fan blade root which locates in a corresponding slot formed in the rim of the fan disc. During service operation, the fan assembly is subject to a complex loading system, consisting of centripetal load, gas-bending and vibration. The dovetail geometry copes particularly well with this kind of loading conditions.

On assembly, the blades are "chocked" up to mate the flanks of the corresponding dovetail slots (in the absence of any centrifugal force when static) by inserting a slider beneath the blade root. When the rotor assembly is spinning, the blades are restrained radially by the dovetail slots, which are sized according to mechanical rules based on extreme load cases.

To prevent the blades moving axially forward or rearward a number of approaches can be employed. One is to use a solid block or plate of metal inserted into machined grooves in the disc either at the front and back of the dovetail slot or mid slot (which requires a corresponding groove machined into the blade root). This approach relies on the shear strength of the plates (and disc grooves) to withstand any axial force placed on them. The plates are sized on the worst case of either large bird impact or trailing blade impact following a fan blade off event.

The large forces seen during these extreme cases lead to a thick plate design and a correspondingly large extension of the disc. This requires larger and more expensive disc forging and increases the disc machining time. In addition, the extension: adds weight and therefore increases specific fuel consumption; can use up engine space and encroach on adjacent components; and can lead to pumping and windage, creating a secondary airflow and associated temperature increase. Further, the shear plate produces a larger part count, which increases costs and assembly time.

The mid slot approach requires machining of the blade root to accommodate the plate, which breaks through the dovetail flanks. This can be acceptable in the case of a metal blade, but may cause issues in a composite blade, where the groove in the blade root is typically perpendicular to the fibre plies in the root and has sharp edges, which may cause stress concentrations. Breaking the flanks can also require the blade root to be extended axially to meet acceptable crushing stress limits (which again lead to a corresponding increase in disc axial length).

Current blade retention approaches also offer little vibrational damping to the blade or disc.

SUMMARY OF THE INVENTION

In a first aspect, the present invention provides a device for chocking and retaining a dovetail root of a blade of a gas turbine engine in a corresponding axially-extending slot in the rim of a disc, the root being mounted in the slot by insertion of a leading end of the root into a proximal end of the slot and then sliding the root towards a distal end of the slot, the device including:

a first wedging body having a key portion receivable in a keyway formed at the distal end of the slot, the keyway restraining the first wedging body against movement in the axial direction, and the first wedging body further having a first angled surface over which a correspondingly angled leading end surface of the root slides when the root is inserted in the slot to urge the leading end of the root radially outwardly; and a second wedging body insertable into the proximal end of the slot between the inserted root and a base of the slot, the second wedging body having a second angled surface which, on insertion of the second wedging body, slides over a correspondingly angled trailing end surface of the root to urge the trailing end of the root radially outwardly;

whereby the angled surfaces of the wedging bodies cause the flanks of the root to mate with flanks of the slot while also retaining the root axially in the slot.

Advantageously, the device can be retained within the forging envelope of the disc, and does not require any extension of the disc, saving on forging and machining costs and weight. Further, the device is compatible with composite blades, not requiring any break in the flanks of the blade root. The cross sectional profiles of the wedging bodies can be configured for shear strength, compressive/buckling strength, weight and vibrational response. Under extreme axial loading, impact energy can be dissipated through shear and compressive forces between the wedging bodies, blade root and disc, rather than pure shear as with a conventional retaining plate.

The key portion may comprise one or more legs and the keyway comprises one or more slots for respectively receiving the legs. Conveniently, the keyway can be formed in the base of the slot.

Another option, however, is for the first wedging body to be an integral part of the disc. Accordingly, in a second aspect, the present invention provides a combination of a disc and a plurality of devices for chocking and retaining dovetail roots of blades of a gas turbine engine in corresponding axially-extending slots in the rim of the disc, each root being mounted in a respective slot by insertion of a leading end of the root into a proximal end of the slot and then sliding the root towards a distal end of the slot;

wherein the disc includes a respective first wedging body integrally formed at the distal end of each slot, each first wedging body having a first angled surface over which a correspondingly angled leading end surface of the respective root slides when the root is inserted in the slot to urge the leading end of the root radially outwardly; and wherein each device includes a second wedging body insertable into the proximal end of a respective one of the slots between the inserted root and a base of the slot, each second wedging body having a second angled surface which, on insertion of the second wedging body, slides over a correspondingly angled trailing end surface of the root to urge the trailing end of the root radially outwardly;

whereby the angled surfaces of the wedging bodies cause the flanks of the roots to mate with flanks of the slots while also retaining the roots axially in the slots.

In a third aspect, the present invention provides a rotor assembly of a gas turbine engine, the assembly having:

a disc;

a circumferential row of blades (e.g. composite blades), each blade having a dovetail root which is inserted in a corresponding axially-extending slot in the rim of the disc, and which has angled leading and trailing end surfaces; and a plurality of devices according to the first aspect for chocking and retaining the dovetail roots of the blades in the slots;

wherein each slot has a keyway formed at the distal end thereof, the key portion of the first wedging body of each device is received in a respective one of the keyways, and the second wedging body of each device is inserted into the proximal end of a respective one of the slots.

In a fourth aspect, the present invention provides a rotor assembly of a gas turbine engine, the assembly having:

a circumferential row of blades (e.g. composite blades), each blade having a dovetail root which has angled leading and trailing end surfaces; and a combination according to the second aspect of a disc and a plurality of devices;

wherein the dovetail root of each blade is inserted in the corresponding axially-extending slot in the rim of the disc, and the second wedging body of each device is inserted into the proximal end of a respective one of the slots to chock and retain the dovetail root of the respective blade in the slot.

For example, in the third or fourth aspect, the assembly can be a fan assembly, with the blades being fan blades, and the disc being a fan disc.

In a fifth aspect, the present invention provides a gas turbine engine having the rotor assembly of the third or fourth aspect.

Optional features of the invention will now be set out. These are applicable singly or in any combination with any aspect of the invention.

The wedging bodies may have relatively compliant outer layers at their angled surfaces for enhanced contact of the wedging bodies with the root. Thus, for example, the outer layers can be formed of an elastomer. In contrast, the remaining parts portion of the wedging bodies can be relatively rigid (being formed e.g. of metal or composite material). The compliant layers can provide damping, impact protection, and take up any tolerance between the root, rotor and wedging bodies.

The first wedging body may have an extension which locates in the slot between the angled surfaces and carries one or more chock springs which are arranged to act on the root to also urge the blade radially outwardly. Likewise, the second wedging body may have an extension at a leading end thereof, the extension entering the slot in advance of the second angled surface to locate between the angled surfaces, and the extension carrying one or more chock springs which are arranged to act on the root to also urge the blade radially outwardly One of the first and second wedging bodies may have a linkage member which extends from that body to the other of the first and second wedging bodies, the device further having a fastener for connecting the other of the first and second wedging bodies to the linkage member and tensioning the linkage member. For example, the linkage member can penetrate through the other wedging body to provide a projecting threaded portion and the fastener can be a nut which screws onto that portion.

The second wedging body may have a stop at an end thereof which, in use, abuts a face of the disc or the root when the second wedging body is fully inserted in the slot to prevent over-insertion of the second wedging body. For example, the stop can be a flange which abuts an external face of the disc and/or the root. Another option is for the stop to abut a surface, such as a flat, provided by the disc and/or the root within the slot.

Generally, the dovetail root and slot are straight, but a curved root and slot are not precluded.

BRIEF DESCRIPTION OF THE DRAWINGS

Embodiments of the invention will now be described by way of example with reference to the accompanying drawings in which:

FIG. 2(*b*) shows schematically a longitudinal cross-sectional view of the device, root and disc. FIG. 2(*c*) shows schematically a transverse section on plane A-A through the device, root and disc;

DETAILED DESCRIPTION AND FURTHER OPTIONAL FEATURES OF THE INVENTION

Figure 1:
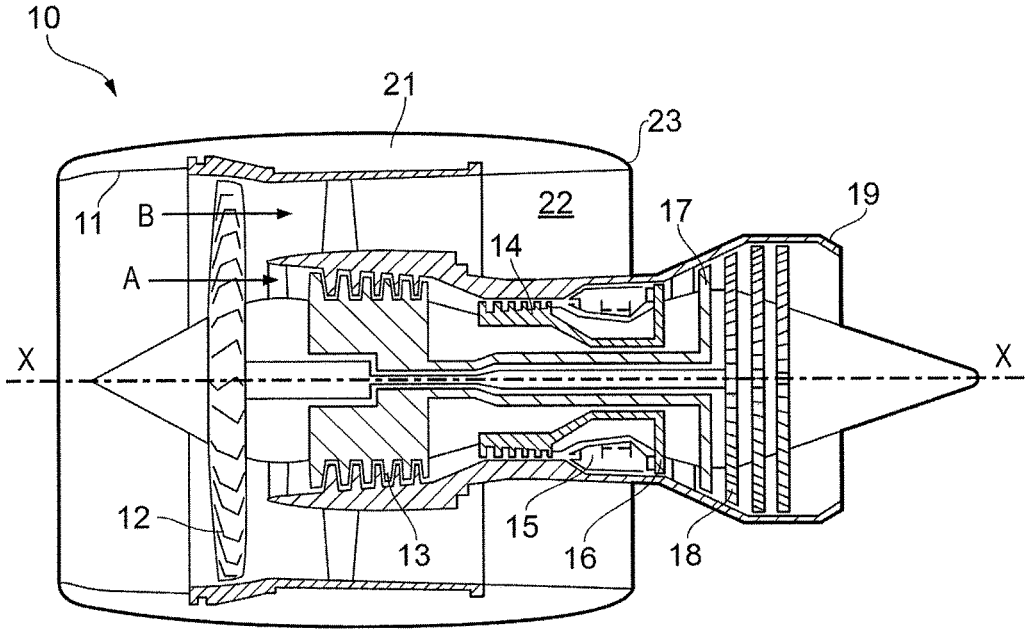
FIG. 1 shows a longitudinal cross-section through a ducted fan gas turbine engine.

With reference to FIG. 1, a ducted fan gas turbine engine incorporating the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate-pressure compressor 13 and a second air flow B which passes through the bypass duct 22 to provide propulsive thrust. The intermediate-pressure compressor 13 compresses the air flow A directed into it before delivering that air to the high-pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate-pressure compressors 14, 13 and the fan 12 by suitable interconnecting shafts.

The fan 12 comprises a fan disc and a circumferential row of fan blades extending from the disc. Each blade has as a dovetail root 30 which is retained in a corresponding axially-extending slot 34 in the rim of the disc 32. To chock the flanks of roots radially outwardly against the flanks of the slots, and to retain the roots axially within the slots, each blade has a chocking and retaining device according to the present invention.

Figure 2A:
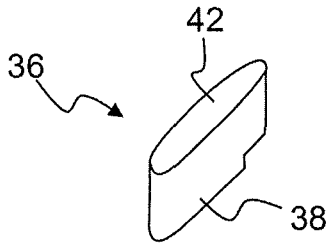
FIG. 2(*a*) shows schematically a perspective view of a first wedging body of a device for chocking and retaining a dovetail root of a blade of a gas turbine engine in a corresponding axially-extending slot in the rim of a disc.
Figure 2B:
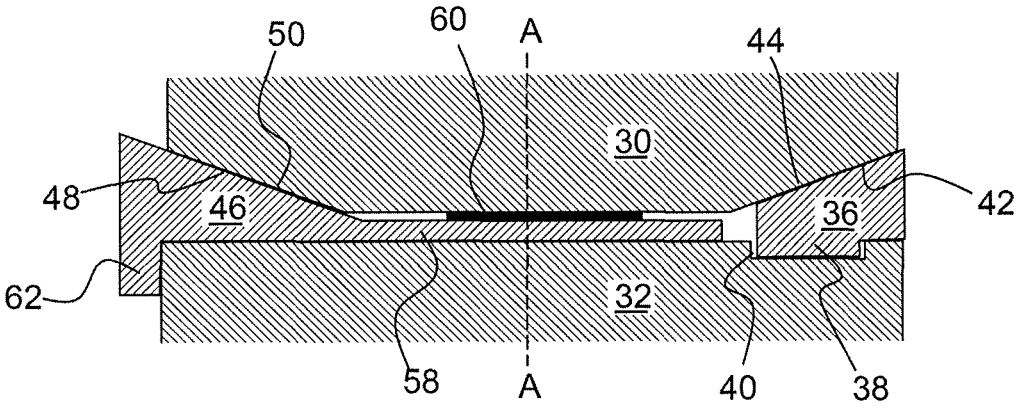
Figure 2C:
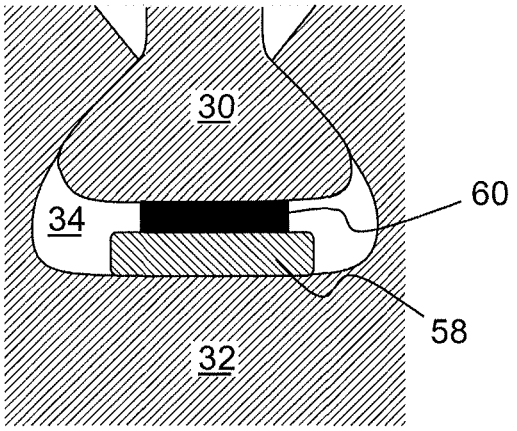

Schematically, FIG. 2(*a*) shows a perspective view of a first wedging body 36 of a device for chocking and retaining the dovetail root 30 of one of the fan blades in its respective axially-extending slot 34, FIG. 2(*b*) shows a longitudinal cross-sectional view of the device, root and disc, and FIG. 2(*c*) shows a transverse section on plane A-A through the device, root and disc.

The first wedging body 36 has a key portion 38 in the form of a leg which inserts into a corresponding slot keyway 40 formed in the base of the slot 34. The key portion and keyway restrain the first wedging body against movement in the axial direction.

The first wedging body 36 also has a first angled surface 42 which slopes downwardly towards the base of the slot 34 from a raised end at a distal end of the slot. The root 30 has a correspondingly angled leading end surface 44. To mount the blade to the disc 32, the root's angled leading end surface 44 meets and slides up the first angled surface 42, the leading end of the root is urged radially outwardly.

The device has a second wedging body 46 which is then inserted into the proximal end of the slot 34 between the inserted root 30 and the base of the slot. The second wedging body has a second wedging body has a second angled surface 48 which slopes downwardly towards the base of the slot from a raised end at the distal end of the slot. The root 30 has a correspondingly angled trailing end surface 50. Thus the insertion of the second wedging body results in the second angled surface 48 meeting and sliding along the angled trailing end surface 50 to urge the trailing end of the root radially outwardly.

Figure 3:
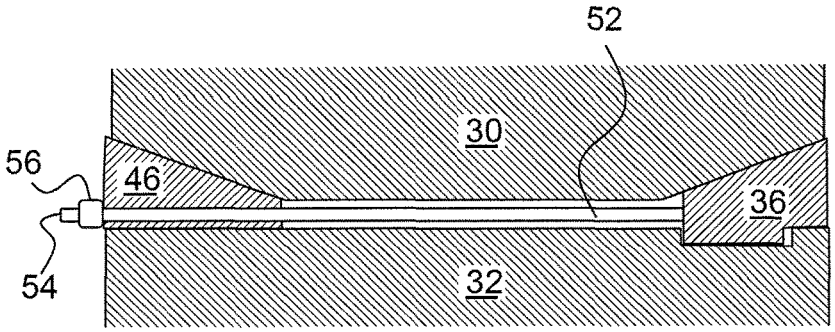
FIG. 3 shows schematically a longitudinal cross-sectional view of a variant device, root and disc.

In this way, the two wedging bodies 36, 46 cause the flanks of the root 30 to mate with flanks of the slot 34. In addition, however, the two angled surfaces 42, 48 sandwich the root therebetween and can be adapted to retain the root axially in the slot. In particular, axial loads on the blade can be transmitted via its root to the wedging bodies, and then transferred to the disc 32. For example, at the first wedging body 36, the transfer can be via shear at the key portion 38 and keyway 40. To restrain the second wedging body 46 against movement in the axial direction out of the slot, one option, shown in FIG. 3, is to provide a linkage member 52 which extends from the first wedging body 36, and penetrates through the second wedging body 46 to provide a projecting threaded portion 54. A nut 56 can then be screwed onto the threaded portion. Another option is to provide a more conventional type of arrangement of a plate or block at the proximal end of the slot, e.g. inserted into a groove in the disc, or the second wedging body 46 can be bolted to the disc 32.

Advantageously, the angled surfaces 42, 48 can reduce stress concentration in the root 30 by their gradual slopes. Under extreme axial loading of the blade, the angled surfaces can help to redistribute some of the axial load as a compressive force, driving the root 30 radially up in the slot 34.

As shown in FIGS. 2(*b*) and 2(*c*), one or both of the wedging bodies 36, 46 (as drawn, it is just the second wedging body 46) can have an extension 58 which locates in the slot 34 between the angled surfaces 42, 48. The extension can carry one or more chock springs 60 (e.g. metallic springs or rubber blocks) which also urge the blade radially outwardly. Such springs can provide a useful damping function. Indeed, the wedging bodies 36, 46 may have a relatively compliant outer layers at their angled surfaces 42, 48 for enhanced contact of the bodies with the root 30. For example, the outer layers can be formed of an elastomer of the bodies with the root 30. For example, the outer layers can be formed of an elastomer to improve damping, impact protection, and take up any tolerance between the root, rotor and retention body.

As shown in FIG. 2(*b*), the second wedging body 46 can have a stop 62 which abuts against the external face of the disc 32 to prevent further insertion of the wedging body.

Figure 4:
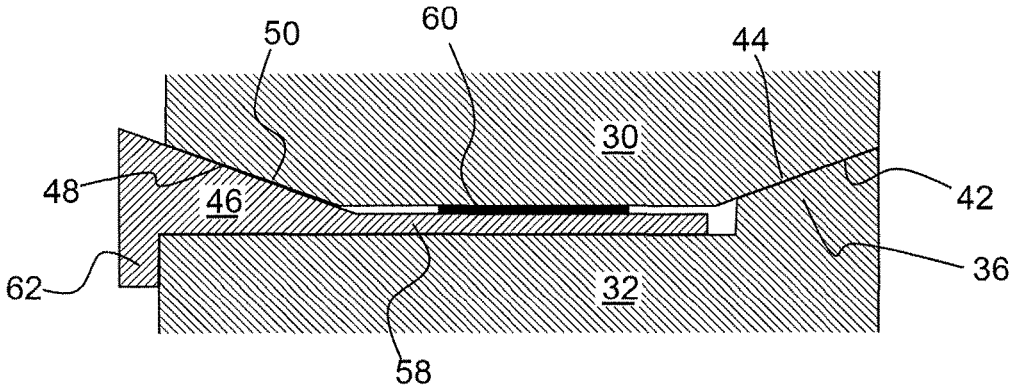
FIG. 4 shows schematically a longitudinal cross-sectional view of a further variant device, root and disc.

FIG. 4 shows schematically a longitudinal cross-sectional view of a further variant device, root and disc. In this variant, the first wedging body 36 is integrally formed with the disc 32. Thus axial loads on the blade can be transmitted directly to the disc via the first wedging body 36.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the scope of the invention.

The invention claimed is:

1. A device for chocking and retaining a dovetail root of a blade of a gas turbine engine in a corresponding axially-extending slot in the rim of a disc, the root being mounted in the slot by insertion of a leading end of the root into a proximal end of the slot and then sliding the root towards a distal end of the slot, the device including:

a first wedging body having a key portion receivable in a keyway formed at the distal end of the slot, the keyway restraining the first wedging body against movement in the axial direction, and the first wedging body further having a first angled surface over which a correspondingly angled leading end surface of the root slides when the root is inserted in the slot to urge the leading end of the root radially outwardly; and a second wedging body insertable into the proximal end of the slot between the inserted root and a base of the slot, the second wedging body having a second angled surface which, on insertion of the second wedging body, slides over a correspondingly angled trailing end surface of the root to urge the trailing end of the root radially outwardly;

whereby the angled surfaces of the wedging bodies cause the flanks of the root to mate with flanks of the slot while also retaining the root axially in the slot.

2. A device according to claim 1, wherein the second wedging body has an extension at a leading end thereof, the extension entering the slot in advance of the second angled surface to locate between the angled surfaces, and the extension carrying one or more chock springs which are arranged to act on the root to also urge the blade radially outwardly.

3. A rotor assembly of a gas turbine engine, the assembly having:

a circumferential row of blades, each blade having a dovetail root which has angled leading and trailing end surfaces; and a combination according to claim 2, of a disc and a plurality of devices;

wherein the dovetail root of each blade is inserted in the corresponding axially-extending slot in the rim of the disc, and the second wedging body of each device is inserted into the proximal end of a respective one of the slots to chock and retain the dovetail root of the respective blade in the slot.

4. A gas turbine engine having the rotor assembly of claim 3.

5. A device according to claim 1, wherein the first wedging body has an extension which locates in the slot between the angled surfaces and carries one or more chock springs which are arranged to act on the root to also urge the blade radially outwardly.

6. A device according to claim 1, wherein the wedging bodies have relatively compliant outer layers at the angled surfaces for enhanced contact of the wedging bodies with the root.

7. A device according to claim 1, wherein one of the first and second wedging bodies has a linkage member which extends from that body to the other of the first and second wedging bodies, the device further having a fastener for connecting the other of the first and second wedging bodies to the linkage member and tensioning the linkage member.

8. A device according to claim 1, wherein the second wedging body has a stop at an end thereof which, in use, abuts a face of the disc or the root when the second wedging body is fully inserted in the slot to prevent over-insertion of the second wedging body.

9. A rotor assembly of a gas turbine engine, the assembly having:

a disc;

a circumferential row of blades, each blade having a dovetail root which is inserted in a corresponding axially-extending slot in the rim of the disc, and which has angled leading and trailing end surface; and a plurality of devices according to claim 1, for chocking and retaining the dovetail roots of the blades in the slots;

wherein each slot has a keyway formed at the distal end thereof, the key portion of the first wedging body of each device is received in a respective one of the keyways, and the second wedging body of each device is inserted into the proximal end of a respective one of the slots.

10. A gas turbine engine having the rotor assembly of claim 9.

11. A combination of a disc and a plurality of devices for chocking and retaining dovetail roots of blades of a gas turbine engine in corresponding axially-extending slots in the rim of the disc, each root being mounted in a respective slot by insertion of a leading end of the root into a proximal end of the slot and then sliding the root towards a distal end of the slot;

wherein the disc includes a respective first wedging body integrally formed at the distal end of each slot, each first wedging body having a first angled surface over which a correspondingly angled leading end surface of the respective root slides when the root is inserted in the slot to urge the leading end of the root radially outwardly; and wherein each device includes a second wedging body insertable into the proximal end of a respective one of the slots between the inserted root and a base of the slot, each second wedging body having a second angled surface which, on insertion of the second wedging body, slides over a correspondingly angled trailing end surface of the root to urge the trailing end of the root radially outwardly;

whereby the angled surfaces of the wedging bodies cause the flanks of the roots to mate with flanks of the slots while also retaining the roots axially in the slots.

12. A combination according to claim 11, wherein each second wedging body has an extension at a leading end thereof, the extension entering the slot in advance of the second angled surface to locate between the angled surfaces, and the extension carrying one or more chock springs which are arranged to act on the root to also urge the blade radially outwardly.

13. A combination according to claim 11, wherein each first wedging body has an extension which locates in the slot between the angled surfaces and carries one or more chock springs which are arranged to act on the root to also urge the blade radially outwardly.

14. A combination according to claim 11, wherein the wedging bodies have relatively compliant outer layers at the angled surfaces for enhanced contact of the wedging bodies with the root.

15. A combination according to claim 11, wherein one of the first and second wedging bodies has a linkage member which extends from that body to the other of the first and second wedging bodies, the device further having a fastener for connecting the other of the first and second wedging bodies to the linkage member and tensioning the linkage member.

16. A combination according to claim 11, wherein each second wedging body has a stop at an end thereof which, in use, abuts a face of the disc or the root when the second wedging body is fully inserted in the slot to prevent over-insertion of the second wedging body.

* * * * *